US009723706B2

(12) United States Patent
Svedberg et al.

(10) Patent No.: US 9,723,706 B2
(45) **Date of Patent: *Aug. 1, 2017**

(54) EXTRACTION SYSTEM AND PARTICLE ACCELERATOR HAVING A FOIL HOLDER

(71) Applicant: General Electric Company, Schenectady, NY (US)

(72) Inventors: Oskar Svedberg, Uppsala (SE); Tomas Eriksson, Uppsala (SE); Jonas Ove Norling, Uppsala (SE); Peter Askebro, Knivsta (SE)

(73) Assignee: General Electric Company, Shenectady, NY (US)

( * ) Notice: Subject to any disclaimer, the term of this patent is extended or adjusted under 35 U.S.C. 154(b) by 26 days.

This patent is subject to a terminal disclaimer.

(21) Appl. No.: 14/920,975

(22) Filed: Oct. 23, 2015

(65) Prior Publication Data

US 2016/0050742 A1 Feb. 18, 2016

Related U.S. Application Data

(63) Continuation of application No. 14/030,689, filed on Sep. 18, 2013, now Pat. No. 9,185,790.

(51) Int. Cl.
*H05H 7/10* (2006.01)
*H05H 13/00* (2006.01)

(52) U.S. Cl.
CPC ..... *H05H 7/10* (2013.01); *H05H 13/005* (2013.01)

(58) Field of Classification Search
USPC ..... 315/500–505
See application file for complete search history.

(56) References Cited

U.S. PATENT DOCUMENTS 3,641,446 A * 2/1972 Gordon ..... H05H 13/00 313/62
3,866,132 A * 2/1975 Gorka, Jr. ..... G21K 1/14 313/149
3,896,392 A * 7/1975 Hudson ..... H05H 7/10 313/62
6,130,926 A * 10/2000 Amini ..... H05H 13/00 315/502
6,462,348 B1 * 10/2002 Gelbart ..... G21K 1/093 250/505.1
7,223,463 B2 * 5/2007 Arakida ..... G21K 1/14 250/251

(Continued)

*Primary Examiner* — Douglas W Owens
*Assistant Examiner* — Srinivas Sathiraju
(74) *Attorney, Agent, or Firm* — Dean D. Small; The Small Patent Law Group, LLC

(57) ABSTRACT

A particle accelerator including an electrical field system and a magnetic field system that are configured to direct a particle beam of charged particles along a designated path within an acceleration chamber. The particle accelerator also includes a foil holder having a beam window and a positioning slot that at least partially surrounds the beam window. The positioning slot is dimensioned to hold an extraction foil such that the extraction foil extends across the beam window and into the path of the charged particles. The positioning slot is defined by interior reference surfaces that face the extraction foil and retain the extraction foil within the positioning slot. The reference surfaces permit the extraction foil to move relative to the reference surfaces when the particle beam is incident on the extraction foil.

20 Claims, 8 Drawing Sheets

(56) References Cited

U.S. PATENT DOCUMENTS

| | | | | |
|---|---|---|---|---|
| 8,106,370 | B2 | 1/2012 | Norling et al. | |
| 8,106,570 | B2 | 1/2012 | Norling et al. | |
| 8,153,997 | B2 | 4/2012 | Norling et al. | |
| 8,374,306 | B2 * | 2/2013 | Norling | G21G 1/10 250/492.3 |
| 8,432,090 | B2 * | 4/2013 | Colard | G21K 1/14 313/62 |
| 2010/0329406 | A1 * | 12/2010 | Norling | G21G 1/10 376/112 |
| 2012/0161671 | A1 | 6/2012 | Eriksson et al. | |
| 2012/0321026 | A1 | 12/2012 | Norling et al. | |
| 2015/0077022 | A1 * | 3/2015 | Svedberg | H05H 13/005 315/502 |

* cited by examiner

EXTRACTION SYSTEM AND PARTICLE ACCELERATOR HAVING A FOIL HOLDER

CROSS-REFERENCE TO RELATED APPLICATION

The present application is a continuation of U.S. patent application Ser. No. 14/030,689, filed on Sep. 18, 2013, which is incorporated herein by reference in its entirety.

BACKGROUND OF THE INVENTION

Various embodiments described herein relate generally to particle accelerators, and more particularly to particle accelerators having extraction foils for stripping electrons from charged particles.

Particle accelerators, such as cyclotrons, may have various industrial, medical, and research applications. For example, particle accelerators may be used to produce radioisotopes (also called radionuclides), which have uses in medical therapy, imaging, and research, as well as other applications that are not medically related. Systems that produce radioisotopes typically include a cyclotron that has a magnet yoke surrounding an acceleration chamber. The cyclotron may include opposing pole tops that are spaced apart from each other. Electrical and magnetic fields may be generated within the acceleration chamber to accelerate and guide charged particles along a spiral-like orbit between the poles. To produce the radioisotopes, the cyclotron forms a particle beam of the charged particles and directs the particle beam out of the acceleration chamber and toward a target system having a target material. The particle beam is incident upon the target material thereby generating radioisotopes.

Known cyclotrons direct the charged particles so that the charged particles are incident upon an extraction foil. For example, the extraction foil may be positioned at an outer edge of the spiral-like orbit so that the charged particles reach a predetermined speed prior to being incident upon the extraction foil. When the charged particles hit the extraction foil, the foil strips electrons from the charged particles causing the particles to change polarity and thereby project out of the acceleration chamber.

In conventional cyclotrons that use extraction foils, the foils are held by a frame within the path of the charged particles. At least two edges of the extraction foil may be secured to the frame (e.g., through clamping or the like) such that the edges have fixed positions with respect to the frame. Another edge of the extraction foil may be exposed and positioned within a path of the charged particles. When the charge particles are incident upon the extraction foil, the extraction foil experiences a significant increase in temperature, such as 750 K or more. The significant temperature change causes the foil to change in size (e.g., expand). The size change is based on the material of the foil and the coefficient of thermal expansion of the material.

Such extraction foils are susceptible to failure. The portions of the extraction foil that are secured by the frame may experience stresses caused by the clamping forces of the frame. In addition, the portion of the extraction foil that receives the charged particles experiences a very significant temperature change. Moreover, the change in size caused by the temperature change creates additional stresses on the extraction foil because the frame holds the edges in fixed positions. More specifically, when the edges have fixed positions, the extraction foil is incapable of expanding or contracting within a plane. Instead, portions of the extraction foil may buckle and/or stretch. Accordingly, the above stresses may cause damage to the extraction foil that eventually leads to foil failure. Although damaged extraction foils may be replaced, such procedures have undesirable consequences. First, the procedure for replacing extraction foils increases radiation exposure to personnel. Second, during the replacement procedure, the cyclotron is not in operation.

Accordingly, there is a need for a particle accelerator that increases the lifetime operation of the extraction foils thereby reducing the frequency of foil replacement.

BRIEF DESCRIPTION OF THE INVENTION

In one embodiment, a particle accelerator is provided that includes an electrical field system and a magnetic field system that are configured to direct a particle beam of charged particles along a designated path within an acceleration chamber. The particle accelerator also includes a foil holder having a beam window and a positioning slot that at least partially surrounds the beam window. The positioning slot is dimensioned to hold an extraction foil such that the extraction foil extends across the beam window and into the path of the charged particles. The positioning slot is defined by interior reference surfaces that face the extraction foil and retain the extraction foil within the positioning slot. The reference surfaces permit the extraction foil to move relative to the reference surfaces when the particle beam is incident on the extraction foil.

In another embodiment, an extraction system for removing electrons from charged particles is provided. The extraction system includes a foil holder having a beam window and a positioning slot that at least partially surrounds the beam window. The positioning slot is dimensioned to hold an extraction foil such that the extraction foil extends across the beam window. The positioning slot is defined by interior reference surfaces that face the extraction foil and retain the extraction foil within the positioning slot. The reference surfaces are dimensioned to permit the extraction foil to move relative to the reference surfaces when the charged particles are incident on the extraction foil.

In yet another embodiment, a method of operating a particle accelerator is provided. The method includes retaining an extraction foil within a positioning slot. The extraction foil has at least one edge portion that defines a profile of the extraction foil and a body portion that is exposed for receiving a particle beam. The positioning slot is defined by interior reference surfaces that face the edge portion wherein at least one of the reference surfaces directly engages the extraction foil. The method also includes directing the particle beam to be incident upon an extraction foil. The edge portion of the extraction foil is permitted to move relative to the reference surfaces.

DETAILED DESCRIPTION OF THE INVENTION

Embodiments described herein include isotope productions systems, particle accelerators, and extraction systems or devices of the same. Particular embodiments include foil holders that may be used with extraction systems of a particle accelerator. The foil holder may be configured to retain one or more extraction foils that are used to strip electrons from charged particles. The foil holder may retain the extraction foils within positioning slots. The extraction foils in some embodiments may not be tightly gripped or clamped by the foil holder thereby reducing unwanted stresses on the extraction foil. The extraction foil may be positioned by the foil holder to extend across a path taken by charged particles during operation of the particle accelerator so that the charged particles are incident on the extraction foil. During the stripping process, thermal energy may be generated within the extraction foil causing the extraction foil to change size and/or shape. Embodiments described herein may have positioning slots that are dimensioned to permit the extraction foil to change in size and/or shape while maintaining the position of the extraction foil relative to the charged particles (or particle beam). Such embodiments may increase the lifetime operation of the extraction foils so that fewer replacement procedures are required.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements that do not have that property.

Figure 1:
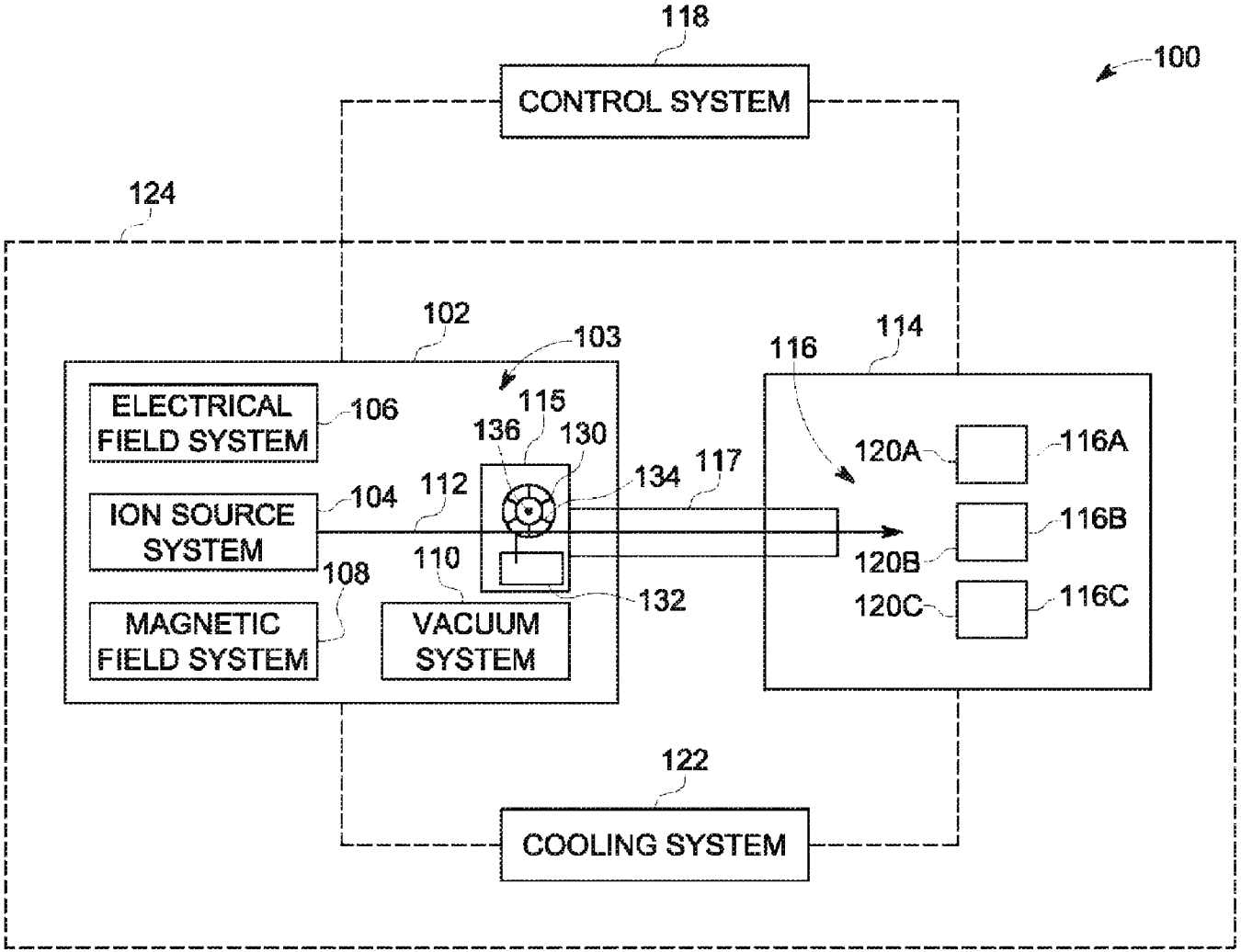
FIG. 1 is a block diagram of a particle accelerator in accordance with one embodiment.

FIG. 1 is a block diagram of an isotope production system 100 formed in accordance with one embodiment. The system 100 includes a particle accelerator 102 that has several sub-systems including an ion source system 104, an electrical field system 106, a magnetic field system 108, and a vacuum system 110. The particle accelerator 102 may be, for example, a cyclotron or, more specifically, an isochronous cyclotron. The particle accelerator 102 may include an acceleration chamber 103. The acceleration chamber 103 may be defined by a housing or other portions of the particle accelerator and is configured to have an evacuated state during operation. The particle accelerator shown in FIG. 1 has at least portions of the sub-systems 104, 106, 108, and 110 located in the acceleration chamber 103.

During use of the particle accelerator 102, charged particles are placed within or injected into the acceleration chamber 103 of the particle accelerator 102 through the ion source system 104. The magnetic field system 108 and the electrical field system 106 generate respective fields that cooperate in producing a particle beam 112 of the charged particles. The charged particles are accelerated and guided within the acceleration chamber 103 along a predetermined or designated path. In cyclotrons, for example, the designated path may be a spiral-like orbit.

During operation of the particle accelerator 102, the acceleration chamber 103 may be in a vacuum (or evacuated) state and experience a large magnetic flux. For example, an average magnetic field strength between pole tops in the acceleration chamber 103 may be at least 1 Tesla. Furthermore, before the particle beam 112 is created, a pressure of the acceleration chamber 103 may be approximately $1\times10^{-7}$ millibars. After the particle beam 112 is generated, the pressure of the acceleration chamber 103 may be approximately $2\times10^{-5}$ millibar.

Also shown in FIG. 1, the system 100 has an extraction system 115 and a target system 114 that includes a target material 116. In some embodiments, the particle accelerator 102 and the target system 114 may be enclosed or housed within a single system housing 124 (indicated by broken lines). However, the target system 114 may be separate from the particle accelerator 102 in other embodiments. The extraction system 115 may be positioned at an edge of the spiral-like orbit. The extraction system 115 includes a foil holder 130 and a rotating motor 132 that is operably coupled to the foil holder 130. The foil holder 130 is illustrated as a revolving device or carousel, but other foil holders may be used in other embodiments. The foil holder 130 is configured to hold one or more extraction foils 134 (a plurality of extraction foils 134 is shown in FIG. 1). The rotating motor 132 is configured to selectively move the foil holder 130 about an axis of rotation 136 to designated rotational positions. For example, the foil holder 130 may be rotated so that different extraction foils 134 are incident on the charged particles. The rotating motor 132 may be, for example, an electromechanical motor that is driven by piezoelectric elements as set forth in U.S. application Ser. No. 12/977,208 (and issued as U.S. Pat. No. 8,653,762), which is incorporated by reference in its entirety.

As shown, the target system 114 is positioned adjacent to the particle accelerator 102. To generate isotopes, the charged particles are directed by the particle accelerator 102 to be incident on the extraction foil 134 of the extraction system 115. For some embodiments, when the charged particles (e.g., negative hydrogen ions) are incident upon the extraction foil 134, electrons of the charged particles may be stripped from the charged particle thereby changing the charge of the particle. The particles may then be directed along a beam passage 117 and into the target system 114 so that the particle beam 112 is incident upon the target material 116 located at a corresponding target location 120. In alternative embodiments, the system 100 may have a target system located within or directly attached to the accelerator chamber 103.

By way of example, the system 100 may use $^{1}H^{-}$ technology and brings the charged particles to a low energy (e.g., about 9.6 MeV) with a beam current of approximately 10-30 μA. In other embodiments, the beam current may be, for example, up to approximately 200 μA or up to 2000 μA or more. Negative hydrogen ions may be accelerated and guided through the particle accelerator 102 and into the extraction system 115. The negative hydrogen ions may then hit the extraction foil 134 of the extraction system 115 thereby removing the pair of electrons and making the particle a positive ion, $^{1}H^{+}$. It is noted, however, embodiments described herein may be applicable to other types of particle accelerators and cyclotrons.

When the particle beam 112 is incident upon the extraction foil 134, the extraction foil 134 may experience a significant rise in temperature. For example, the extraction foil 134 may experience an increase in temperature of about 750K or more. Significant temperature changes may cause portions of the extraction foil 134 to expand (or contract) in size. As described in greater detail below, embodiments are configured to permit the extraction foil to change in size and/or move relative to the foil holder so that unwanted stresses sustained by the foil are reduced.

Also shown in FIG. 1, the system 100 may have multiple target locations 120A-C where separate target materials 116A-C are located. A shifting device or system (not shown) may be used to shift the target locations 120A-C with respect to the particle beam 112 so that the particle beam 112 is incident upon a different target material 116. A vacuum may be maintained during the shifting process as well. Alternatively, the particle accelerator 102 and the extraction system 115 may not direct the particle beam 112 along only one path, but may direct the particle beam 112 along a unique path for each different target location 120A-C. Furthermore, the beam passage 117 may be substantially linear from the particle accelerator 102 to the target location 120 or, alternatively, the beam passage 117 may curve or turn at one or more points therealong. For example, magnets positioned alongside the beam passage 117 may be configured to redirect the particle beam 112 along a different path.

The system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. By way of example, the system 100 may generate protons to make $^{18}F^{-}$ isotopes in liquid form, $^{11}C$ isotopes as $CO_2$, and $^{13}N$ isotopes as $NH_3$. The target material 116 used to make these isotopes may be enriched $^{18}O$ water, natural $^{14}N_2$ gas, $^{16}O$-water. The system 100 may also generate protons or deuterons in order to produce $^{15}O$ gases (oxygen, carbon dioxide, and carbon monoxide) and $^{15}O$ labeled water.

The system 100 may also include a control system 118 that may be used by a technician to control the operation of the various systems and components. The control system 118 may include one or more user-interfaces that are located proximate to or remotely from the particle accelerator 102 and the target system 114. In some embodiments, the control system 118 may be configured to receive data regarding the operability or suitability of the extraction foil 134. For instance, the control system 118 may inform a use that the extraction foil 134 has failed and that a new extraction foil 134 should be positioned within the path of the charged particles. Such information may be obtained by detecting a current from the extraction foil 134. In some embodiments, the control system 118 may automatically rotate the foil holder 130 so that a different extraction foil 134 is positioned within the path.

Although not shown in FIG. 1, the system 100 may also include one or more radiation and/or magnetic shields for the particle accelerator 102 and the target system 114. The system 100 may include a cooling system 122 that transports a cooling or working fluid to various components of the different systems in order to absorb heat generated by the respective components.

The system 100 may also be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. In particular embodiments, the system 100 accelerates the charged particles to an energy of approximately 9.6 MeV or less. In more particular embodiments, the system 100 accelerates the charged particles to an energy of approximately 7.8 MeV or less. However, embodiments describe herein may also have an energy above 18 MeV. For example, embodiments may have an energy above 100 MeV, 500 MeV or more.

The system 100 and, more specifically, the particle accelerator 102 may include features described in U.S. application Ser. No. 12/977,208 (and issued as U.S. Pat. No. 8,653,762), which is incorporated by reference in its entirety.

Figure 2:
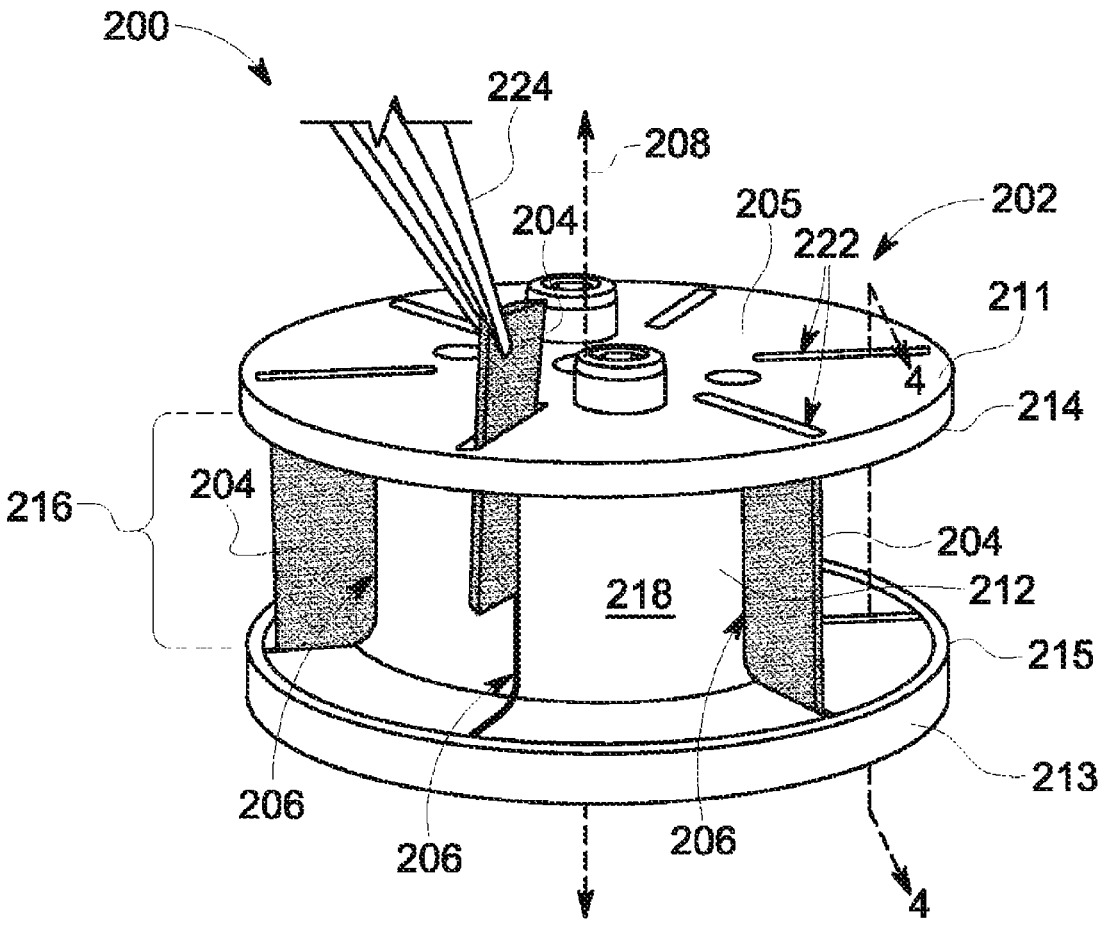
FIG. 2 is an enlarged perspective view of a holder body of a foil holder that may be used with the particle accelerator of FIG. 1.

FIG. 2 is a perspective view of an extraction device 200 that may be used in a particle accelerator, such as the particle accelerator 102 (FIG. 1) of the isotope production system 100 (FIG. 1). The extraction device 200 includes a foil holder 202 and a plurality of extraction foils 204. The extraction device 200 may also include a holder cover 210 (shown in FIG. 9). In the illustrated embodiment, the foil holder 202 is configured to hold and position six (6) extraction foils 204 so that charged particles (not shown) from the particle accelerator may be incident upon the corresponding extraction foil 204. In other embodiments, the foil holder 202 may hold fewer extraction foils (e.g., only one extraction foil) or more extraction foils. The extraction foil 204 may be a substantially rectangular and thin sheet of suitable material, but other shapes may be used in other embodiments. For example, the extraction foil 204 may have a substantially circular profile. The foil material may include carbon and graphite. Typically the foil material is a high melting point, low density material with low radio activation potential, but can be any material capable of sufficiently stripping electrons from the charged particles passing through. By way of example only, the extraction foil may be a carbon/graphite foil having about 1-2 μm thickness.

The foil holder 202 includes a holder body 205 having a plurality of positioning slots 206 that are each sized and shaped to hold one of the extraction foils 204. The foil holder 202 may also include fasteners or other components and, in some embodiments, the extraction foils 204. In one or more embodiments, the positioning slots 206 are dimensioned to permit the extraction foils 204 to freely expand or contract within the positioning slot 206. The positioning slots 206 may be defined by interior reference surfaces (described below) that retain the extraction foils while also permitting edge portions of the extraction foils 204 to move relative to the reference surfaces.

For example, the holder body 205 may include body portions 211-213, including first and second plate portions 211, 213 and an intermediate portion 212 disposed between the plate portions 211, 213. In the illustrated embodiment, the holder body 205 is a single continuous piece of material. For example, the plate portions 211, 213 and the intermediate portion 212 may be molded and shaped from a common piece of material (e.g., graphite) to include the features described herein. In alternative embodiments, however, one or more of the plate portions 211, 213 or the intermediate portion 212 may be separate from the others. For example, each of the plate portions 211, 213 and the intermediate portion 212 may be a separate component that is secured to the other components to form the holder body 205.

In the illustrated embodiment, the foil holder 202 is configured to be rotated about an axis of rotation 208 to different designated rotational positions. As such, the plate portions 211, 213 and the intermediate portion 212 may have substantially circular cross-sections taken transverse to the axis of rotation 208. The plate portions 211, 213 may be referred to as discs in some embodiments. However, in other embodiments, the foil holder 202 or the body portions 211-213 are only partially circular (e.g., semi-circular). For example, instead of having circular cross-sections and being configured to hold six (6) extraction foils 204, the body portions 211-213 may have semi-circular cross-sections that are configured to hold only three (3) or four (4) extraction foils 204.

The holder body 205 includes a beam-receiving channel 216 that extends around the axis of rotation 208. The beam-receiving channel 216 is defined by the plate portions 211, 213 and the intermediate portion 212. As shown, the beam-receiving channel 216 opens radially outward from the axis of rotation 208 such that the beam-receiving channel 216 is open-sided. The beam-receiving channel 216 is defined by an exterior channel surface 218. The channel surface 218 extends along the plate portions 211, 213 and the intermediate portion 212. As shown in FIG. 2, the positioning slots 206 are formed within the channel surface 218.

In the illustrated embodiment, the channel surface 218 is a single continuous surface that extends from a radial edge 214 of the plate portion 211 along the intermediate portion 212 to a radial edge 215 of the plate portion 213. For embodiments in which the body portions 211-213 are separate components, however, the channel surface 218 may be collectively formed by separate surfaces of the components. Accordingly, the term "channel surface" may describe a single continuous surface that defines the beam-receiving channel 216 or multiple surfaces that collectively define the beam-receiving channel 216.

As shown in FIG. 2, the plate portion 211 may include a plurality of elongated slot openings 222. The slot openings 222 provide access to corresponding positioning slots 206. For example, as shown in FIG. 2, a tool 224 (e.g., pliers) may be used to insert the extraction foils 204 through the slot openings 222 and into the respective positioning slots 206. As the extraction foils 204 are advanced through the positioning slots 206, the extraction foil 204 advances across the beam-receiving channel 216. After the extraction foil 204 has been inserted into the positioning slot 206, the extraction foil 204 is disposed transverse to the beam-receiving channel 216 such that the extraction foil 204 separates or divides the beam-receiving channel 216. Once the desired number of extraction foils 204 have been positioned within the holder body 205, the holder cover 210 (shown in FIG. 9) may be mounted to the plate portion 211 thereby covering the slot openings 222 so that the extraction foils 204 are confined within the positioning slot 206.

Figure 3:
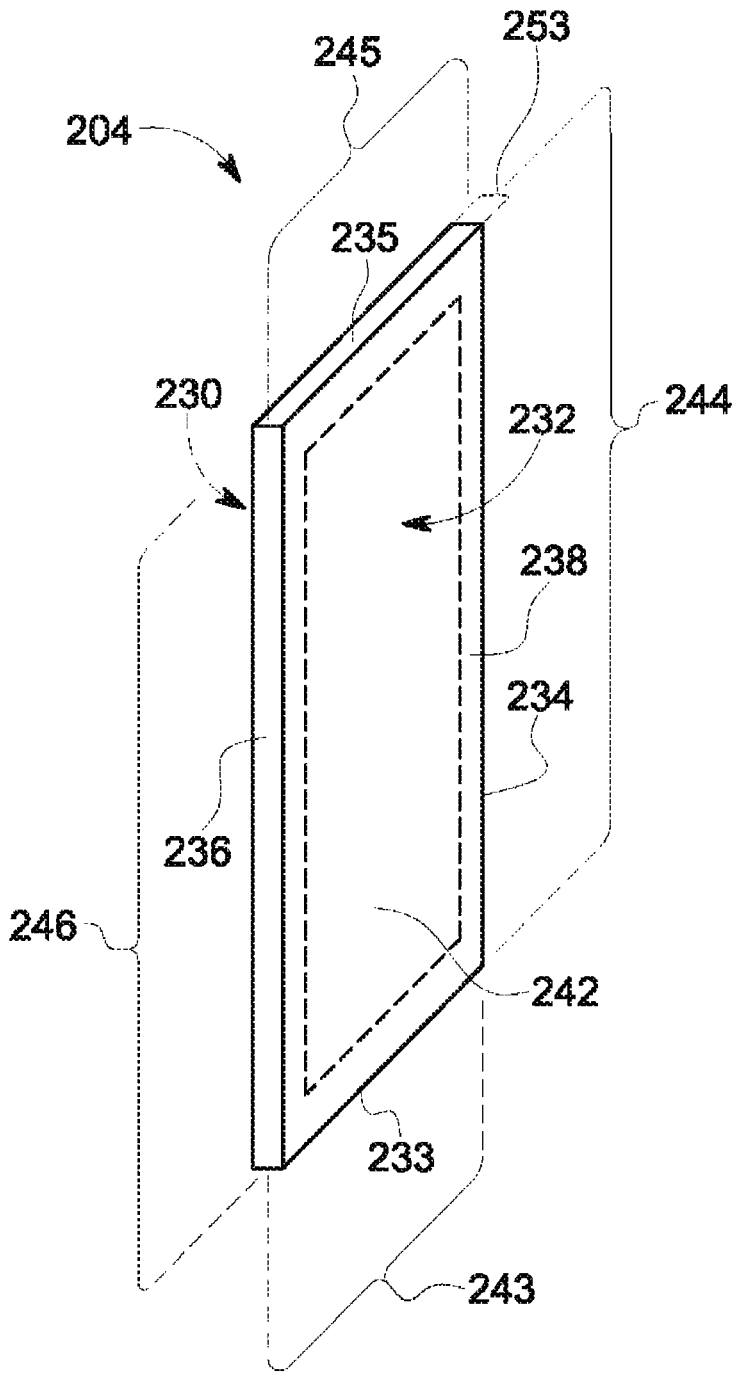
FIG. 3 is a perspective view of an extraction foil that may be used by one or more embodiments described herein.

FIG. 3 illustrates an exemplary extraction foil 204 that may be used by embodiments described herein. In FIG. 3, dimensions of the extraction foil 204 have been modified for illustrative purposes. Nonetheless, it is understood that embodiments may be selectively configured to utilize an extraction foil having predetermined dimensions or to utilize various types of extraction foils. As shown, the extraction foil 204 includes opposite side surfaces 230, 232 and foil edges 233-236 that extend between the opposite side surfaces 230, 232. In FIG. 3, the side surfaces 230, 232 are shown as being substantially planar and the foil edges 233-236 are shown as being substantially linear. It is understood, however, that extraction foils may readily yield (e.g., bend) when external forces are applied and may be shaped to have various contours. The foil edges 233-236 extend along a perimeter of the extraction foil 204 and may define a profile of the extraction foil 204 when the extraction foil 204 is substantially planar. The profile in FIG. 3 is substantially rectangular, but the extraction foil 204 may have other profiles in other embodiments.

As shown, the extraction foil 204 includes an edge portion 238 that extends around the perimeter of the extraction foil 204. The edge portion 238 is defined between the broken line and the foil edges 233-236 in FIG. 3. The edge portion 238 includes the foil edges 233-236 and also a portion of the side surfaces 230, 232. The edge portion 238 may include at least one covered segment and at least one exposed segment. For example, the edge portion 238 includes covered segments 243-245 which extends along and includes the foil edges 233-235, respectively. The covered segments 243-245 may collectively form a C shape. The edge portion 238 also includes an exposed segment 246 that extends along and includes at least a portion of the foil edge 236.

In the illustrated embodiment, the edge portion 238 surrounds a body portion 242 of the extraction foil 204. When the extraction foil 204 is retained with the corresponding positioning slot 206 (FIG. 2), the body portion 242 and the exposed segment 246 of the edge portion 238 are exposed. For example, the body portion 242 and the exposed segment 246 are not covered by the holder body 205 (FIG. 2) and are capable of directly receiving charged particles (not shown). Also shown in FIG. 3, the extraction foil 204 may have a height or thickness 253 that extends between the side surfaces 230, 232. The extraction foil 204 also has a length 255 and a width 251 (shown in FIG. 6).

Figure 4:
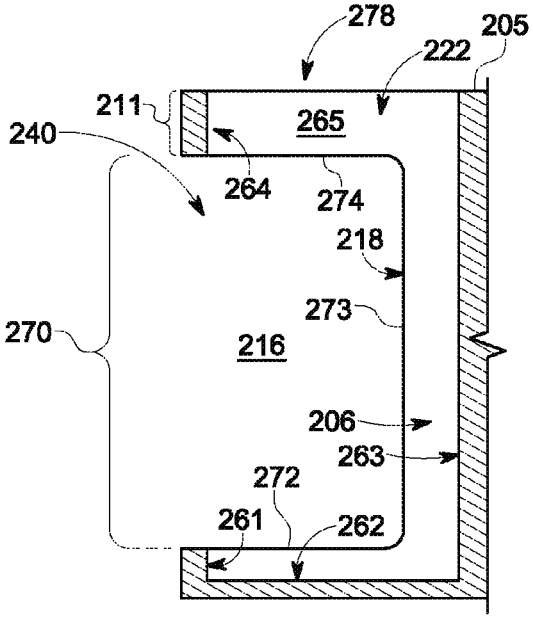
FIG. 4 is a cross-section of the foil holder of FIG. 2 illustrating dimensions of a positioning slot for holding an extraction foil.

FIG. 4 is a cross-section of a portion of the holder body 205 taken along the lines 4-4 in FIG. 2. More specifically, the cross-section is taken through one of the positioning slots 206. The positioning slot 206 extends around and partially defines a section of the beam-receiving channel 216. The illustrated section may be referred to as a beam window 240. The beam window 240 is a planar portion (e.g., slice) of the beam-receiving channel 216 that is configured to be positioned within a path of the particle beam (not shown) when the extraction foil 204 (FIG. 2) is held within the positioning slot 206. More specifically, the beam window 240 and the extraction foil 204 are configured to extend orthogonal to a path direction of the particle beam so that the charged particles are incident on the extraction foil 204.

The positioning slot 206 may constitute a void (e.g., cut-out, recess, cavity, and the like) of the holder body 205 that extends a depth into the holder body 205 from the channel surface 218 and extends longitudinally around the beam window 240. Dimensions of the positioning slot 206 may be configured to retain the extraction foil 204 within the positioning slot 206 during operation of the particle accelerator. As used herein, the term "retained" includes holding the extraction foil 204 in a designated position relative to the holder body 205. In some embodiments, the extraction foil 204 may be retained within the positioning slot 206 without compressive forces (e.g., without clamping or pinching) sustained by the extraction foil 204. For instance, the extraction foil 204 may rest within the positioning slot 206 such that the only force experienced by the extraction foil 204 is gravity and incidental frictional forces between the extraction foil 204 and interior reference surfaces that define the positioning slot 206. In some embodiments, the extraction foil 204 may rest within the positioning slot 206 without resins or adhesives coupling the extraction foil 204 to the reference surfaces. Alternatively, resins or adhesives that permit the extraction foil to move within the positioning slot 206 may be used.

In one embodiment, the positioning slot 206 is defined by interior reference surfaces 261-265 and an interior reference surface 266 (shown in FIG. 4). The reference surfaces 261-266 are surfaces of the holder body 205 and may be formed when, for example, the holder body 205 (or components thereof) are molded and/or shaped. In some embodiments, the material of the holder body 205 may be graphite. Unlike clamps that may be used in conventional systems, the reference surfaces 261-266 are not moveable with respect to each other in other embodiments. In some embodiments, however, one or more of the reference surfaces 261-266 may be moveable relative to the other reference surfaces. For example, one or more portions of the holder body 205 may be removed to position the extraction foil 204.

As shown, the positioning slot 206 opens to the channel surface 218. The channel surface 218 along the positioning slot 206 may extend around and at least partially define a perimeter or profile of the beam window 240. For example, in the illustrated embodiment, a majority of the beam window 240 is framed by the channel surface 218 that extends along the positioning slot 206. More specifically, the beam window 240 is framed by slot edges 272-274 defined between the channel surface 218 and the reference surface 265. More specifically, the slot edges 272-274 are defined where the channel surface 218 joins or intersects with the reference surface 265. Although not shown, the positioning slot 206 may also be defined by slot edges that are formed where the channel surface 218 joins or intersects the reference surface 265. The positioning slot 206 or, more specifically, the channel surface 218 along the positioning slot 206 may be C-shaped or L-shaped in some embodiments. Also shown, the beam window 240 or the beam-receiving channel 216 includes an open side 270.

The reference surfaces 261-266 are configured to face the extraction foil 204 when the extraction foil 204 is disposed within and retained by the positioning slot 206. More specifically, the reference surfaces 265 and 266 may face each other and the side surfaces 230, 232 (FIG. 3), respectively, when the extraction foil 204 is disposed within the positioning slot 206. As such, the reference surfaces 265, 266 may be referred to as broadside-reference surfaces. The reference surface 263 may face the foil edge 234 (FIG. 3), the reference surface 262 may face the foil edge 233 (FIG. 3), and the reference surfaces 261 and 264 may face the foil edge 236 (FIG. 3). As such, the reference surfaces 261-264 may be referred to as edge-reference surfaces. When the extraction foil 204 is retained within the positioning slot 206, at least one of the reference surfaces 261-266 may directly engage the extraction foil 204. Also shown in FIG. 4, the slot opening 222 provides access to the positioning slot 206. More specifically, the plate portion 211 includes an outer surface 278 that includes the slot opening 222.

Figure 5:
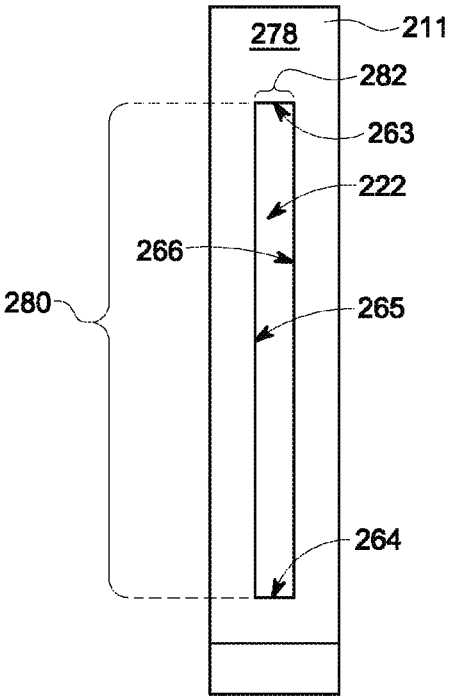
FIG. 5 is an enlarged view of a slot opening that provides access to the positioning slot.

FIG. 5 is an enlarged view of the slot opening 222 along the outer surface 278 of the plate portion 211. The slot opening 222 may be sized and shaped to receive a width 251 (shown in FIG. 6) and the thickness 253 (FIG. 3) of the extraction foil 204. For example, the slot opening 222 has a width 280 and a height 282. The height 282 of the slot opening 222 is defined between the opposing reference surfaces 265, 266, and the width 280 is defined between the opposing reference surfaces 263, 264. In the illustrated embodiment, the dimensions of the positioning slot 206 (FIG. 2) are substantially uniform. More specifically, the positioning slot 206 may also have the height 282 and the width 280 uniformly throughout. In other embodiments, however, dimensions of the positioning slot 206 may vary.

Figure 6:
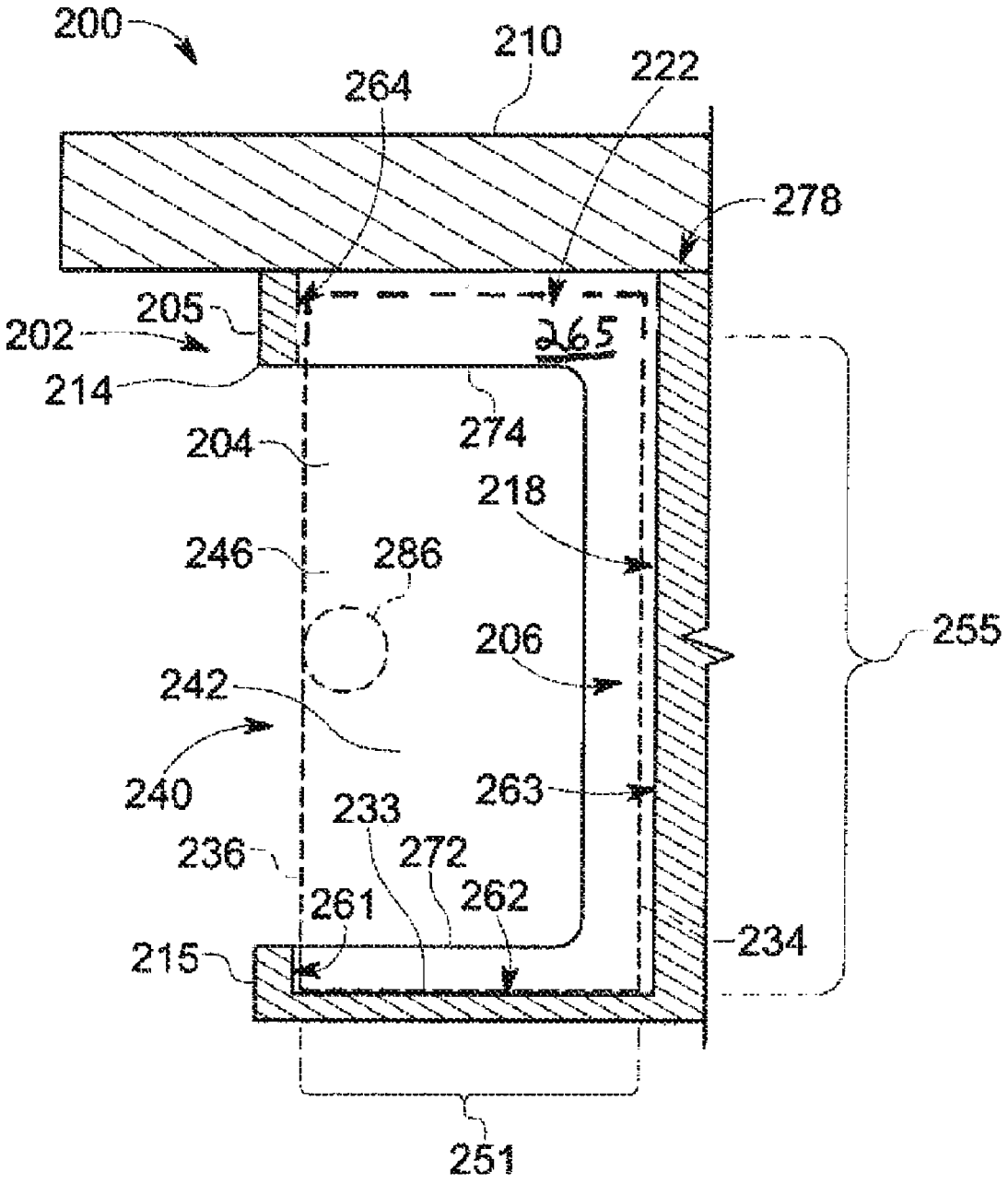
FIG. 6 is a cross-section of the foil holder of FIG. 2 showing the extraction foil retained within the positioning slot.
Figure 8:
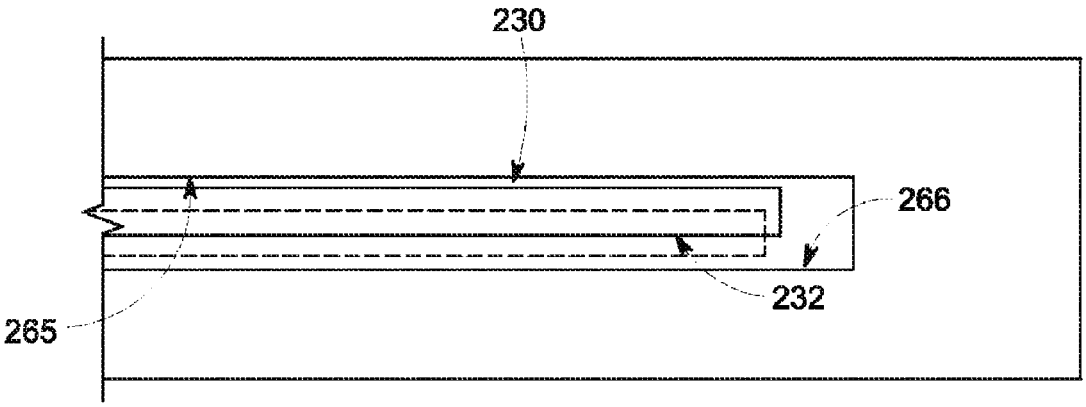
FIG. 8 is an enlarged view of the slot opening illustrating movement of the extraction foil within the positioning slot when charged particles are incident on the extraction foil.

FIG. 6 is a cross-section of a portion of the extraction device 200 that illustrates the extraction foil 204 retained within the positioning slot 206 of the foil holder 202. For illustrative purposes, the extraction foil 204 is indicated by broken lines. As shown, the holder cover 210 is mounted to the holder body 205 along the outer surface 278 thereby covering the slot opening 222 to the positioning slot 206. In the embodiment shown in FIG. 6, the reference surface 261 faces the foil edge 236; the reference surface 262 faces the foil edge 233; the reference surface 263 faces the foil edge 234; the reference surface 264 faces the foil edge 236; the reference surface 265 faces the side surface 230 (FIG. 3); and, as shown in FIG. 8, the reference surface 266 faces the side surface 232. It is noted that the locations of the foil edges 233-236 within the positioning slot 206 are for illustration only and that the foil edges 233-236 may have other locations in other embodiments. For example, the foil edge 235 may be closer to or further away from the holder cover 210.

Depending upon the location of the extraction foil 204 within the positioning slot 206 and the contour of the extraction foil 204, one or more of the reference surfaces 261-266 may directly engage the portion of the extraction foil 204 that the corresponding reference surface faces. For example, the foil edge 233 and the reference surface 262 are directly engaging each other in FIG. 6. The holder body 205 may be oriented such that gravity causes the foil edge 233 to rest upon the reference surface 262. However, FIG. 6 illustrates just one example and the extraction foil 204 may engage other reference surfaces that define the positioning slot 206.

As shown in FIG. 6, the body portion 242 and the exposed segment 246 are exposed within the beam window 240. In the illustrated embodiment, the exposed segment 246 is defined between the opposing slot edges 272, 274 along the channel surface 218. However, in alternative embodiments, the extraction foil 204 may clear one or more of the radial edges 214, 215 such that the exposed segment 246 is not located within the portion of the beam window 240 defined between the slot edges 272, 274.

As shown, a beam spot 286 is located along the exposed segment 246 and the body portion 242. The beam spot 286 represents a cross-section of the particle beam (not shown) when incident on the extraction foil 204. The extraction foil 204 extends substantially orthogonal (perpendicular) to the path taken by the charged particles. During operation of the particle accelerator, the particle beam may be incident upon the extraction foil 204 at the beam spot 286. Thermal energy generated at the beam spot 286 may be conveyed to other portions of the extraction foil 204. Portions of the extraction foil 204 that experience an increase in thermal energy may expand (or contract). The amount of expansion and/or contraction may be based on a coefficient of thermal expansion for the material of the extraction foil 204. As such, at least one of a size or shape of the extraction foil 204 may change during operation of the particle accelerator. Nonetheless, the positioning slot 206 is dimensioned by the reference surfaces 261-266 to hold the extraction foil 204 such that the extraction foil 204 or, more specifically, the portion of the extraction foil 204 that directly receives the charged particles, substantially maintains a designated position relative to the particle beam. As such, the positioning slot 206 may be dimensioned to permit movement of the extraction foil 204 while substantially maintaining a position of the extraction foil 204.

Figure 7:
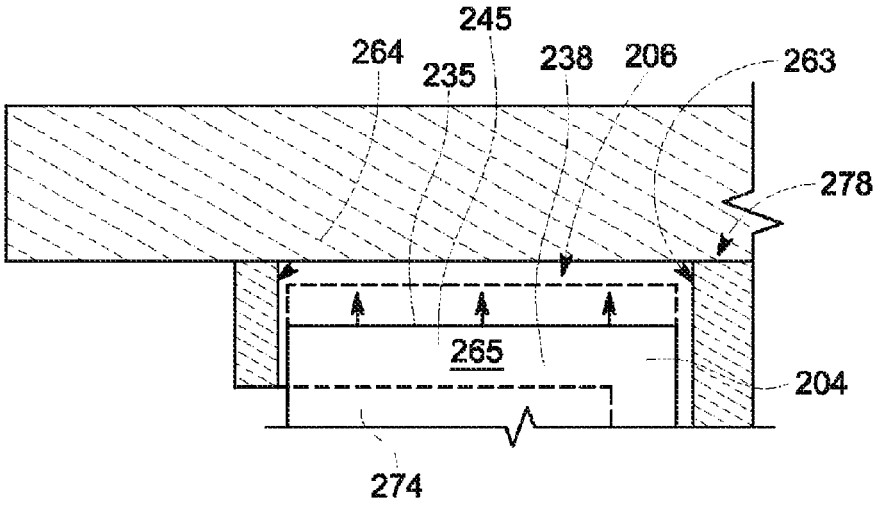
FIG. 7 is an enlarged view of the cross-section of the foil holder illustrating movement of the extraction foil within the positioning slot when charged particles are incident on the extraction foil.

FIGS. 7 and 8 illustrate movement of the extraction foil 204 within the positioning slot 206. One or more portions of the extraction foil 204 may move relative to the reference surfaces 261-266 (FIG. 3) when the charged particles generate thermal energy within the extraction foil 204. As shown in FIG. 7, the covered segment 245 of the edge portion 238 may move relative to the reference surfaces 263-265. The covered segment 245 may also move relative to the reference surface 266 (FIG. 8). For example, if the extraction foil 204 is expanding, the foil edge 235 may extend or move closer to the outer surface 278 of the holder body 205 or may move further from the slot edge 274 as indicated by the arrows in FIG. 7. As shown in FIG. 8, the side surfaces 230, 232 may move with respect to the reference surfaces 265, 266. For example, the side surfaces 230, 232 may move away from the reference surface 265 and closer to the reference surface 266. It is noted that the location of foil edge 235 is to illustrate movement of the extraction foil 204 only. Depending upon the configuration of the positioning slot 206, the foil edge 235 may be closer to or further from the holder cover 210.

Figure 9:
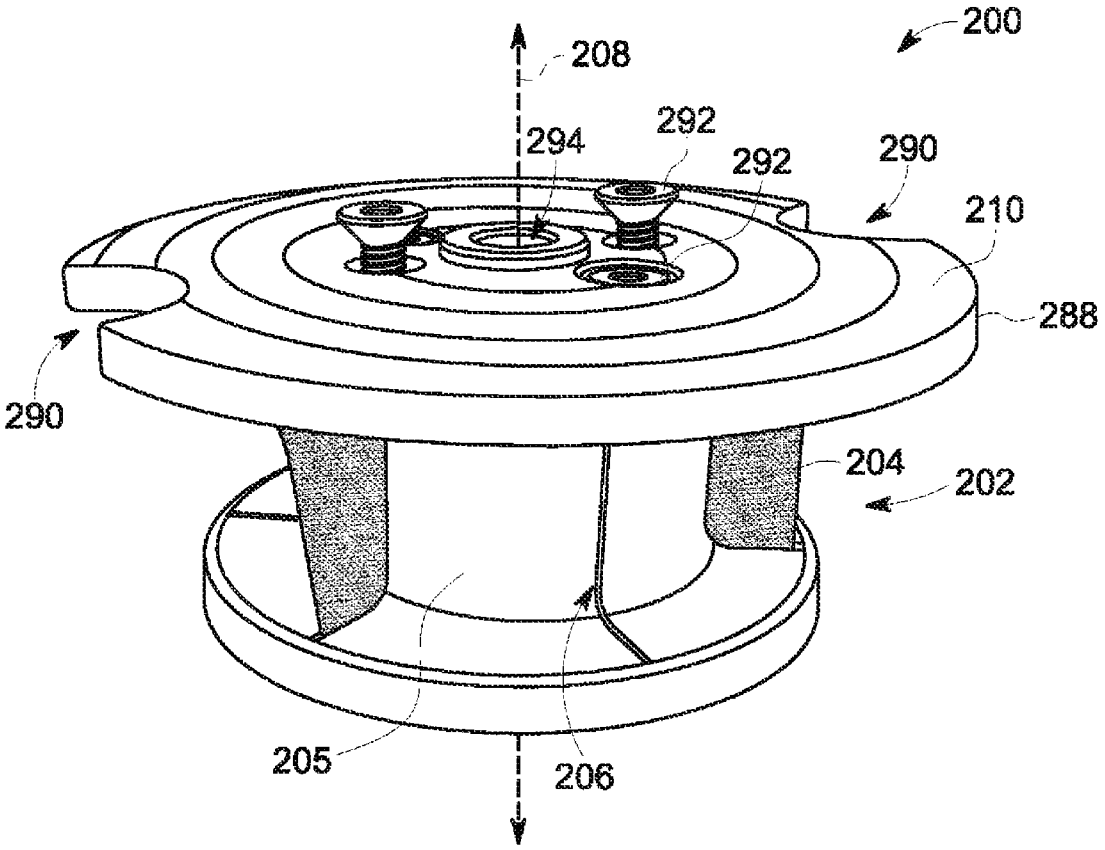
FIG. 9 is a perspective view of the foil holder in which a holder cover is mounted to the holder body.

FIG. 9 is a perspective view of the extraction device 200 in which the holder cover 210 has been mounted to the foil holder 202 or the holder body 205. More specifically, the holder cover 210 is mounted onto the outer surface 278 (FIG. 4) of the holder body 205 thereby covering the slot openings 222 (FIG. 2). In some embodiments, the extraction foils 204 may be disposed entirely within the positioning slots 206. However, in other embodiments, the extraction foils 204, when resting within the positioning slots 206, may clear the outer surface 278 such that a portion of the extraction foil 204 is located between the holder cover 210 and the holder body 205.

In some embodiments, the holder cover 210 also has a substantially circular cross-section when viewed along the axis of rotation 208. The holder cover 210 includes a radial edge 288. In the illustrated embodiment, the holder cover 210 has a diameter that is greater than a diameter of the plate portion 211 (FIG. 2) such that the radial edge 288 clears and is located beyond the radial edge 214 (FIG. 2). The holder cover 210 may include recesses or notches 290 along the radial edge 214. The recesses 290 may facilitate gripping the holder cover 210 during an installation or removal process. Also shown, the holder cover 210 may be secured to the holder body 205 using one or more fasteners 292, which are illustrated as screws in FIG. 9. However, other types of fasteners may be used in alternative embodiments.

As shown, the foil holder 202 includes a bore 294 that is configured to receive a shaft or rod (not shown) that is operably attached to a rotating motor (not shown). The rotating motor may be similar to the rotating motor 132 (FIG. 1). The rotating motor is configured to rotate the shaft thereby rotating the foil holder 202. In this manner, the foil holder 202 may be selectively rotated to designated orientations in order to position an extraction foil 204 within a path of the charged particles. In some embodiments, the foil holder 202 is configured to be shifted in a direction that is orthogonal to the axis of rotation 208. For example, the shaft may be shifted so that the extraction foils 204 are effectively moved to different positions without rotating the shaft.

Figure 10:
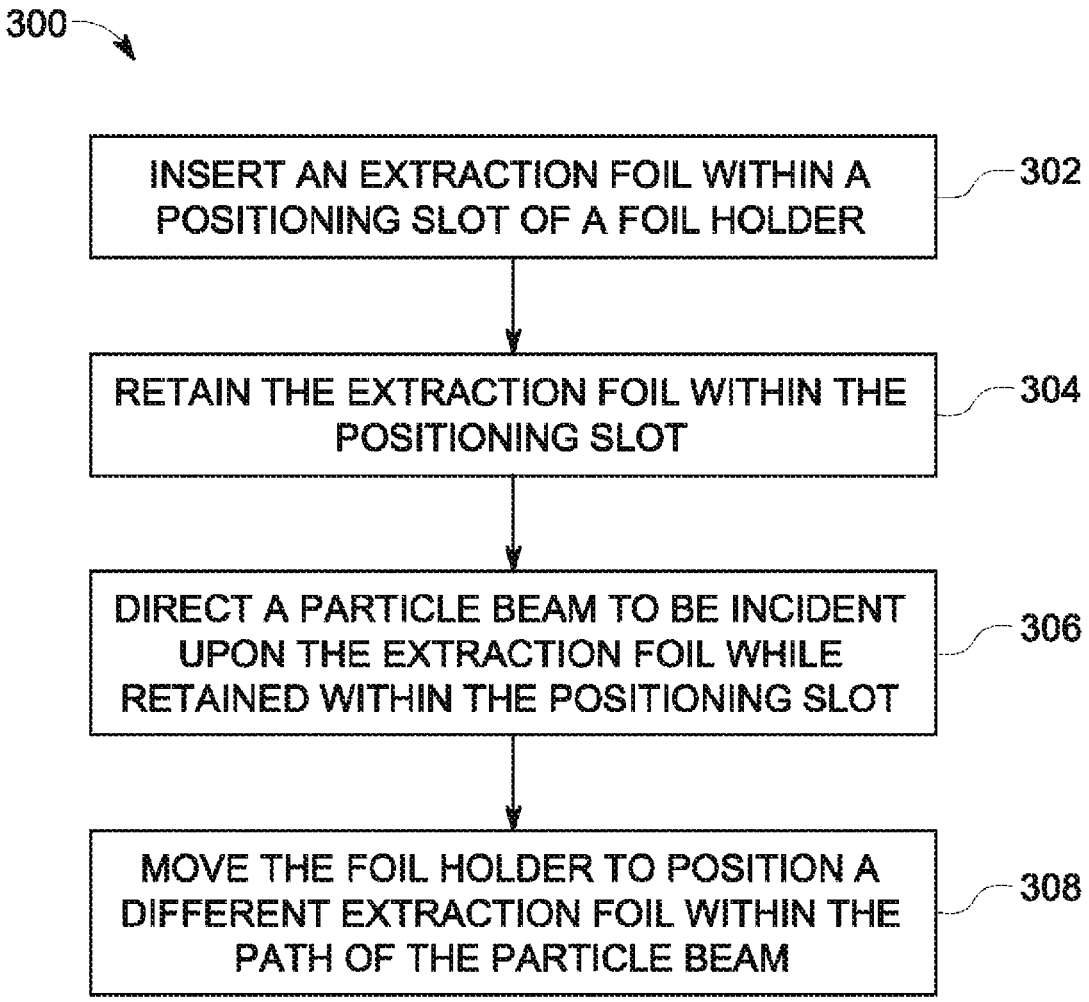
FIG. 10 is a flowchart illustrating a method of operating a particle accelerator in accordance with one embodiment.

FIG. 10 is a flowchart illustrating a method 300 of operating a particle accelerator in accordance with one embodiment. The method 300, for example, may employ structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion.

The method 300 may include inserting (at 302) an extraction foil within a positioning slot. The inserting (at 302) may include inserting an edge of the extraction foil through a slot opening that provides access to the positioning slot, such as the slot opening 222 and the positioning slot 206 described above. The method 300 also includes retaining (at 304) the extraction foil within the positioning slot. The retaining operation may be accomplished by the dimensions of the positioning slot. More specifically, the dimensions of the positioning slot may be configured to at least slightly exceed a thickness of the extraction foil and a width of the extraction foil. In this manner, the extraction foil may slide along or proximate to reference surfaces that define the positioning slot during the positioning operation. Moreover, the dimensions of the positioning slot may permit at least some movement of the extraction foil while substantially maintaining a designated position or orientation of the extraction foil. In particular embodiments, the extraction foil is not secured in a fixed position by clamping or other compressive forces.

When the extraction foil is located within the positioning slot, the reference surfaces may face the extraction foil and one or more of the reference surfaces may directly engage the extraction foil. For example, the extraction foil may have at least one edge portion that defines a profile of the extraction foil and a body portion that is exposed for receiving a particle beam. The edge portion may directly engage one or more of the reference surfaces.

The method 300 may also include directing (at 306) a particle beam to be incident upon the extraction foil. When the charged particles hit the extraction foil, electrons from the extraction foil may be removed. In some embodiments, the electrons may accumulate to form a current that is transmitted through the holder body that defines the positioning slot. Concurrently, the charged particles may generate thermal energy (heat) within the extraction foil. Due to the dimensions of the positioning slot, the thermal energy may cause the extraction foil to move therein (e.g., through expansion or contraction). For example, the edge portion of the extraction foil may be permitted to move relative to the reference surfaces. In some cases, the edge portion of the extraction foil moves relative to the reference surfaces when thermal energy causes the extraction foil to change in at least one of size or shape.

In some embodiments, the foil holder may include multiple positioning slots. As such, the method 300 may also include moving (at 308) the foil holder to position a different extraction foil within a path of the particle beam. For example, the foil holder may be rotated about an axis of rotation to position the other extraction foil.

In particular embodiments, the particle accelerators and cyclotrons are sized, shaped, and configured for use in hospitals or other similar settings to produce radioisotopes for medical imaging. However, embodiments described herein are not intended to be limited to generating radioisotopes for medical uses. Furthermore, in the illustrated embodiments, the particle accelerators are vertically-oriented isochronous cyclotrons. However, alternative embodiments may include other kinds of cyclotrons or particle accelerators and other orientations (e.g., horizontal).

In one embodiment, a particle accelerator is provided that may include an electrical field system and a magnetic field system configured to direct a particle beam of charged particles along a designated path within an acceleration chamber. The particle accelerator may include a foil holder having a beam window and a positioning slot that at least partially surrounds the beam window. The positioning slot is dimensioned to hold an extraction foil such that the extraction foil extends across the beam window and into the path of the charged particles. The positioning slot is defined by interior reference surfaces that face the extraction foil and retain the extraction foil within the positioning slot. The reference surfaces permit the extraction foil to move relative to the reference surfaces when the particle beam is incident on the extraction foil.

In one aspect, the positioning slot may only partially surround the beam window such that an edge of the extraction foil is exposed within or proximate to the beam window.

In another aspect, the positioning slot may be substantially C-shaped or L-shaped as the positioning slot at least partially surrounds the beam window.

In another aspect, at least three of the references surfaces may have fixed positions with respect to one another. For example, the at least three reference surfaces may include first, second, and third reference surfaces. The first and second reference surfaces may directly oppose each other and be configured to face opposite side surfaces of the extraction foil. The third reference surface may be configured to face an edge of the extraction foil.

In another aspect, the foil holder may include a holder body having an outer surface that faces away from the positioning slot. The foil holder has an elongated slot opening along the outer surface that is shaped to receive the extraction foil. The slot opening provides access to the positioning slot.

In another aspect, the foil holder may include a holder body that defines a beam-receiving channel that curves about an axis of rotation. The foil holder may be configured to rotate about the axis of rotation.

In another aspect, the foil holder may include a plurality of the positioning slots that are each configured to hold a corresponding extraction foil.

In another embodiment, an extraction system for removing electrons from charged particles is provided. The extraction system may include a foil holder that has a beam window and a positioning slot that at least partially surrounds the beam window. The positioning slot may be dimensioned to hold an extraction foil such that the extraction foil extends across the beam window. The positioning slot may be defined by interior reference surfaces that face the extraction foil and retain the extraction foil within the positioning slot. The reference surfaces may be dimensioned to permit the extraction foil to move relative to the reference surfaces when the charged particles are incident on the extraction foil.

In one aspect, the positioning slot may only partially surround the beam window such that an edge of the extraction foil is exposed within or proximate to the beam window.

In another aspect, at least three of the references surfaces may have fixed positions with respect to one another.

In another aspect, the foil holder may include a holder body having an outer surface that faces away from the positioning slot. The foil holder has an elongated slot opening along the outer surface that is shaped to receive the extraction foil. The slot opening provides access to the positioning slot.

In another aspect, the foil holder may be configured to be rotated about an axis of rotation. The foil holder may include a plurality of the positioning slots that are each configured to hold a corresponding extraction foil. Each of the positioning slots may extend radially away from the axis of rotation.

In another aspect, the extraction system includes the extraction foil, wherein more than half of a perimeter of the extraction foil is covered by the foil holder.

In another embodiment, a method of operating a particle accelerator is provided. The method may include positioning an extraction foil within a positioning slot. The extraction foil has at least one edge portion that defines a profile of the extraction foil and a body portion that is exposed for receiving a particle beam. The positioning slot may be defined by interior reference surfaces that face the edge portion, wherein at least one of the reference surfaces directly engages the extraction foil. The method may also include directing the particle beam to be incident upon an extraction foil. The edge portion of the extraction foil may be permitted to move relative to the reference surfaces.

In one aspect, positioning the extraction foil within the positioning slot may include permitting the extraction foil to rest within the positioning slot, wherein gravity causes the extraction foil to rest against at least one of the reference surfaces such that the extraction foil is retained within the positioning slot.

In another aspect, the references surfaces may include first and second reference surfaces that oppose each other and face respective side surfaces of the extraction foil. The first and second reference surfaces may be separated by at least a designated distance measured along a thickness of the extraction foil. The designated distance may be greater than the thickness of the extraction foil.

In another aspect, the extraction foil is not secured in a fixed position by clamping.

In another aspect, the positioning slot may be one of a plurality of positioning slots of a foil holder. The method may also include rotating the foil holder to position a different extraction foil within a path of the particle beam.

In another aspect, the extraction foil is substantially rectangular and the edge portion includes at least two covered edge portions and at least one exposed edge portion. The covered edge portions may be disposed within the positioning slot.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An extraction system comprising a foil holder having a plurality of positioning slots that at least partially surround respective beam windows, the positioning slots being dimensioned to hold corresponding extraction foils such that the corresponding extraction foils extend across the respective beam windows, the positioning slots being defined by interior reference surfaces of the foil holder that face the corresponding extraction foils and retain the corresponding extraction foils within the corresponding positioning slots.

2. The extraction system of claim 1, wherein the positioning slots are dimensioned to permit the corresponding extraction foils to move relative to the reference surfaces of the corresponding positioning slots when the extraction foils expand or contract.

3. The extraction system of claim 1, further comprising a motor that is operably coupled to the foil holder and is configured to selectively move the foil holder to position the beam windows within a path of charged particles.

4. The extraction system of claim 3, wherein the motor is configured to selectively rotate the foil holder about an axis of rotation or selectively shift the foil holder in a linear direction.

5. The extraction system of claim 3, wherein the motor is configured to selectively rotate the foil holder about an axis of rotation.

6. The extraction system of claim 5, wherein the positioning slots have different radial positions relative to the axis of rotation.

7. The extraction system of claim 5, wherein the positioning slots are substantially C-shaped or L-shaped such that the positioning slots open away from the axis of rotation.

8. The extraction system of claim 1, wherein at least three of the reference surfaces for each of the positioning slots have fixed positions with respect to one another.

9. The extraction system of claim 1, further comprising the extraction foils, the extraction foils being positioned within the corresponding positioning slots, wherein the corresponding positioning slots are dimensioned to permit the corresponding extraction foils to move relative to the reference surfaces when the particle beam is incident on the corresponding extraction foils.

10. The extraction system of claim 1, wherein the foil holder includes a beam-receiving channel that extends around the foil holder, the beam windows being corresponding slices of the beam-receiving channel.

11. The extraction system of claim 1, wherein the foil holder includes a body portion having an outer surface, the outer surface including slot openings, the slot openings providing access to the corresponding positioning slots such that the extraction foils are capable of being inserted through the slot openings and into the corresponding positioning slots.

12. A particle accelerator comprising:

an electrical field system and a magnetic field system configured to direct a particle beam along a designated path within an acceleration chamber; and a foil holder having a plurality of positioning slots that at least partially surround respective beam windows, the positioning slots being dimensioned to hold corresponding extraction foils such that the corresponding extraction foils extend across the respective beam windows, the positioning slots being defined by interior reference surfaces of the foil holder that face the corresponding extraction foils and retain the corresponding extraction foils within the corresponding positioning slots; and a motor that is operably coupled to the foil holder and is configured to move the foil holder to selectively position the extraction foils within a path of charged particles.

13. The particle accelerator of claim 12, wherein the positioning slots are dimensioned to permit the corresponding extraction foils to move relative to the reference surfaces of the corresponding positioning slots when the extraction foils expand or contract.

14. The particle accelerator of claim 12, wherein the motor is configured to selectively shift the foil holder.

15. The particle accelerator of claim 12, wherein the motor is configured to selectively rotate the foil holder about an axis of rotation.

16. The particle accelerator of claim 15, wherein the positioning slots have different radial positions relative to the axis of rotation.

17. A method of operating a particle accelerator, the method comprising:

positioning extraction foils within corresponding positioning slots of a foil holder, each of the extraction foils having at least one edge portion that defines a profile of the corresponding extraction foil and a body portion that is exposed for receiving a particle beam of the particle accelerator, the positioning slots being defined by interior reference surfaces of the foil holder, at least one of the reference surfaces directly engaging the extraction foil within the corresponding positioning slot;

directing the particle beam to be incident upon a first extraction foil of the plurality of extraction foils, the foil holder having a first rotational position when the particle beam is incident upon the first extraction foil; and rotating the foil holder about an axis of rotation from the first rotational position to a second rotational position, wherein a second extraction foil of the plurality of extraction foils is positioned within a path of the particle beam when the foil holder has the second rotational position.

18. The method of claim 17, wherein positioning the extraction foils within the corresponding positioning slots includes permitting the extraction foils to rest within the corresponding positioning slots.

19. The method of claim 17, wherein the references surfaces of at least one positioning slot include first and second reference surfaces that oppose each other and face respective side surfaces of the corresponding extraction foil, the first and second reference surfaces being separated by at least a designated distance measured along a thickness of the corresponding extraction foil, the designated distance being greater than the thickness of the corresponding extraction foil.

20. The method of claim 17, wherein the extraction foil is not secured in a fixed position by clamping.

* * * * *